United States Patent [19]

Sakashita

[11] 3,986,424

[45] Oct. 19, 1976

[54] AUTOMATIC RHYTHM-ACCOMPANIMENT APPARATUS FOR ELECTRONIC MUSICAL INSTRUMENT

[75] Inventor: Masao Sakashita, Tokyo, Japan

[73] Assignee: Kabushiki Kaisha Kawai Gakki Seisakusho (Kawai Musical Instrument Manufacturing Co., Ltd.), Hamamatsu, Japan

[22] Filed: Oct. 3, 1975

[21] Appl. No.: 619,354

[52] U.S. Cl. ..... 84/1.03; 84/DIG. 12; 84/DIG. 22; 84/1.17; 84/1.24

[51] Int. Cl.[2] ..... G10F 1/00

[58] Field of Search ..... 84/1.01, 1.03, 1.11, 84/1.17, 1.19, DIG. 12, DIG. 22, 1.24

[56] References Cited

UNITED STATES PATENTS

| | | | |
|---|---|---|---|
| 3,288,904 | 11/1966 | George | 84/1.01 |
| 3,548,066 | 12/1970 | Freeman | 84/1.03 |
| 3,718,748 | 2/1973 | Bunger | 84/1.24 |
| 3,789,718 | 2/1974 | Bunger | 84/1.01 |
| 3,921,491 | 11/1975 | Freeman | 84/1.03 X |

*Primary Examiner*—Ulysses Weldon
*Attorney, Agent, or Firm*—Haseltine, Lake & Waters

[57] ABSTRACT

An automatic rhythm accompaniment apparatus for an electronic musical instrument is characterized in that the same comprises a plurality of chord-memory circuits which detect and memorize respective first tones in respective bars of a melody played by the operation of keys, and a chord gate circuit which is driven by output signals of these chord memory circuits and rhythm pulses generated by a rhythm pulse generator so that, by opening and closing of the chord gate circuit, there is obtained rhythm-accompaniment tones caused by the first tones in the respective bars. A key selection circuit is provided at the front stage of the chord gate circuit so that rhythm accompaniment tones according to a key of the melody played may be obtained. A chord change-over circuit can be provided preceding the chord gate circuit so that a key of the melody can be selected. Rhythm-accompaniment tones of different chords appearing in the middle of the melody may be obtained.

11 Claims, 5 Drawing Figures

AUTOMATIC RHYTHM-ACCOMPANIMENT APPARATUS FOR ELECTRONIC MUSICAL INSTRUMENT

FIELD OF THE INVENTION

This invention relates to an automatic rhythm-accompaniment apparatus for an electronic musical instrument of the type in which rhythm tones can be obtained automatically along with a melody played by the operation of keys.

BACKGROUND

It has been conventional with automatic rhythm-accompaniment apparatus used in electronic musical instruments that, when a player depresses several keys, for example, with the left hand, rhythm tones or rhythm-base tones corresponding to chords of the keys depressed are obtained by rhythm pulses generated in an automatic rhythm pulse generator. In such case, the player must play a melody with his right hand. As a result, this operation is very difficult for a beginner who must effect key depression with his left hand and, at the same time, obtain a melody with his right hand.

SUMMARY OF THE INVENTION

It is an object of the invention to avoid such difficulties for beginners or other players.

According to a first aspect of this invention, there are employed a plurality of chord memory circuits which detect respective first tones in respective bars of a melody played by the operation of keys, for memorizing the same as chord signals, and a chord gate circuit which is driven by output signals of those chord-memory circuits and rhythm pulses generated in a rhythm-pulse generator so that, by an opening and closing of the chord-gate circuit, there may be obtained rhythm-accompaniment tones for chords as derived from the first tones in the respective bars.

According to a second aspect of this invention, a key selection circuit is provided at the first stage of the chord gate circuit so that rhythm-accompaniment tones according to a key of the melody played may be obtained.

According to a third aspect of this invention, a key selection circuit and a chord change-over circuit are provided at the first stage of the chord gate circuit so that a key of the melody may be selected by the former and rhythm-accompaniment tones of different chords appearing in the middle of the melody may be obtained by the latter.

BRIEF DESCRIPTION OF THE DRAWING

An embodiment of the invention will next be explained with reference to the accompanying drawings in which.

DETAILED DESCRIPTION

Figure 1:
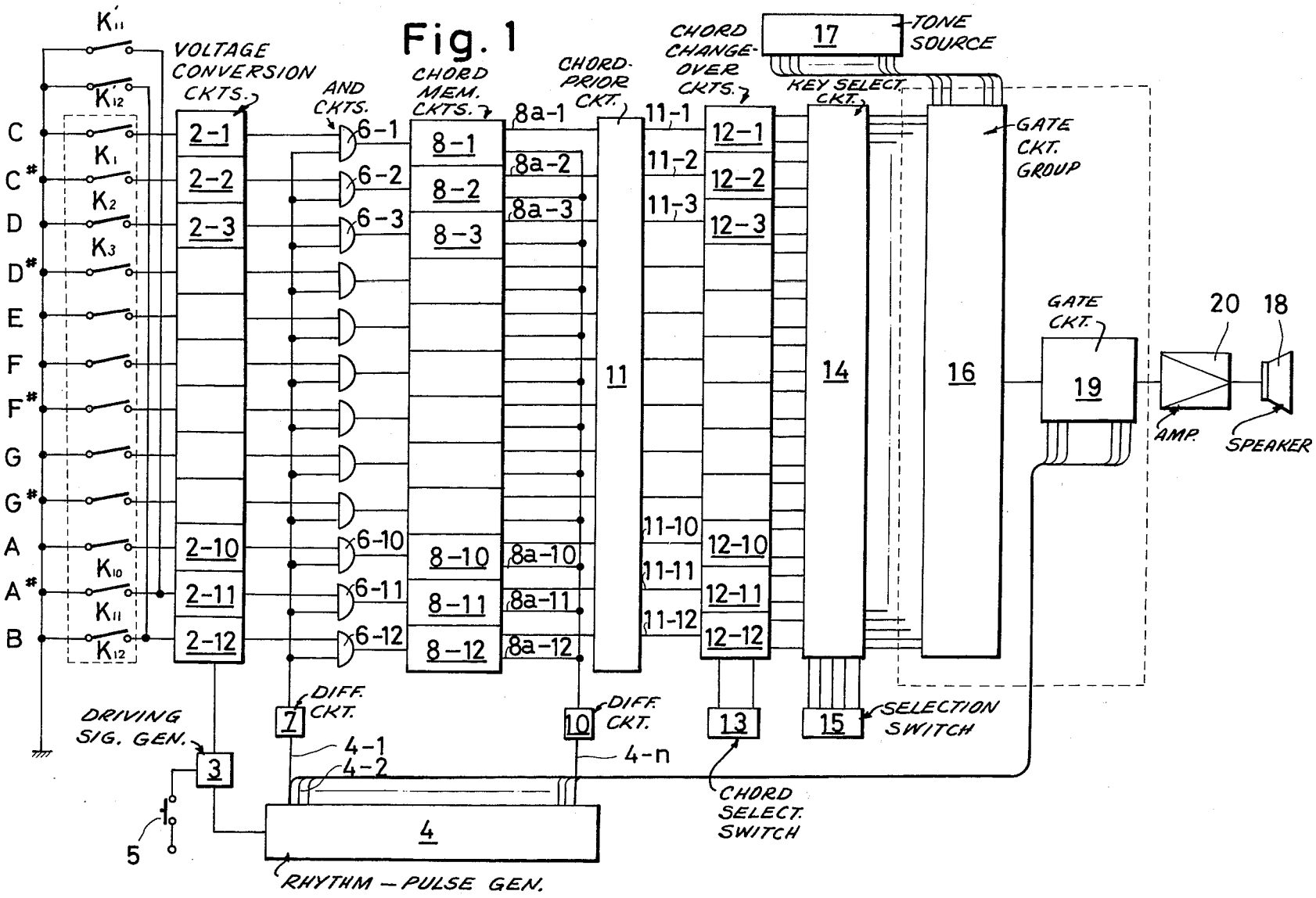
FIG. 1 is a block diagram illustrating a preferred embodiment of the invention.

In FIG. 1, elements K1, K2....K12 are key switches which are closed in conjunction with the depressing of keys for the playing of a melody. Circuits

2-1,2-2....2-12 are voltage-conversion circuits provided at output terminals of the key switches K1, K2...K12.

Circuit 3 is a driving signal generator which is connected to the voltage-conversion circuits 2-1....2-12 and is arranged for transmitting a driving signal to a rhythm-pulse generator under the control of a first output voltage generated in any of circuits 2-1...2-12. The driving pulse generator 3 comprises a differential circuit for differentiating the output voltage of any of the voltage-conversion circuits 2-1....2-12 and a flip-flop circuit which is reset by a differentiated waveform passed therethrough for transmitting an input to the rhythm-pulse generator 4.

Element 5 is a set switch which serves to restore the flip-flop circuit to its set condition. Circuits 6-1....6-12 are AND circuits. These circuits 6-1...6-12 each have two input terminals. One group of input terminals thereof are connected to respective output terminals of the voltage-conversion circuits 2-1...2-12. The other input terminals thereof are connected, through a differential circuit 7 serving as a waveform circuit, to a first output terminal 4-1, at which an output pulse of the first beat is obtained, of the rhythm pulse generator 4.

Circuits 8-1....8-12 are chord-memory circuits provided at the output sides of the AND circuits 6-1...6-12. Each of circuits 8-1...8-12 comprises a flip-flop circuit so constructed that, as described in detail hereinafter, it is reset by the output of the corresponding AND circuit 6-1...6-12 and is kept in that condition during the playing of a melody in a single bar. More particularly the flip-flop circuits constituting the chord-memory circuits 8-1...8-12 are connected at their reset terminals to the final rhythm-pulse output terminal **4-*n* of the rhythm-pulse generator 4, and the rhythm pulse generator 4 generates, in order, rhythm pulses for one bar at respective output terminals 4-1...4-*n*. Any of the flip-flop circuits previously reset may be set by the final pulse produced at the end of the pulse generator. Circuit 10** is a differential circuit serving as a waveform forming circuit.

Respective output terminals **8*a*-1....8*a*-12 of the chord-memory circuits 8-1...8-12 are connected to a chord-priority circuit 11. When the circuit 11 receives output signals simultaneously from two or more output terminals of the chord-memory circuits 8-1...8-12,** the chord with the lower tone is given priority.

Circuits 12-1...12-12 are chord change-over circuits. Change-over of the chords between two series, that is, between the P1...P12 series and **S1...*s*2 series, can be effected by a selection operation controlled by a selection switch 13, as will be explained in detail hereinafter. Circuit 14 is a key selection circuit for selecting a musical key to obtain a chord according to the key of the melody played. It is arranged that, by the selection operation of a selection switch circuit 15, respective chord gates in a gate-circuit group 16 provided on the output side thereof can be selected and, by cooperation thereof with the chord change-over circuits 12-1...12-12, the output terminals of the priority circuit 11** may be selectively connected to any desired chord gate.

These chord gates are connected to respective output terminals of a tone source 17, and output terminals of the chord gates are connected in common so as to connect to a speaker 18. There is interposed in this circuit a gate circuit 19 driven by respective outputs **4-1...4-*n* of the rhythm-pulse generator 4. Gate circuit 19 can be omitted and the respective chord gates can be controlled to open and close directly due to rhythm pulses supplied from the rhythm-pulse generator 4 and output signals supplied from the chord-memory circuits 8-1...8-12. Circuit 20** is an amplifier.

Next, the above apparatus will be explained with reference to more specific circuit diagrams detailing various aspects of the circuits.

Figure 2:
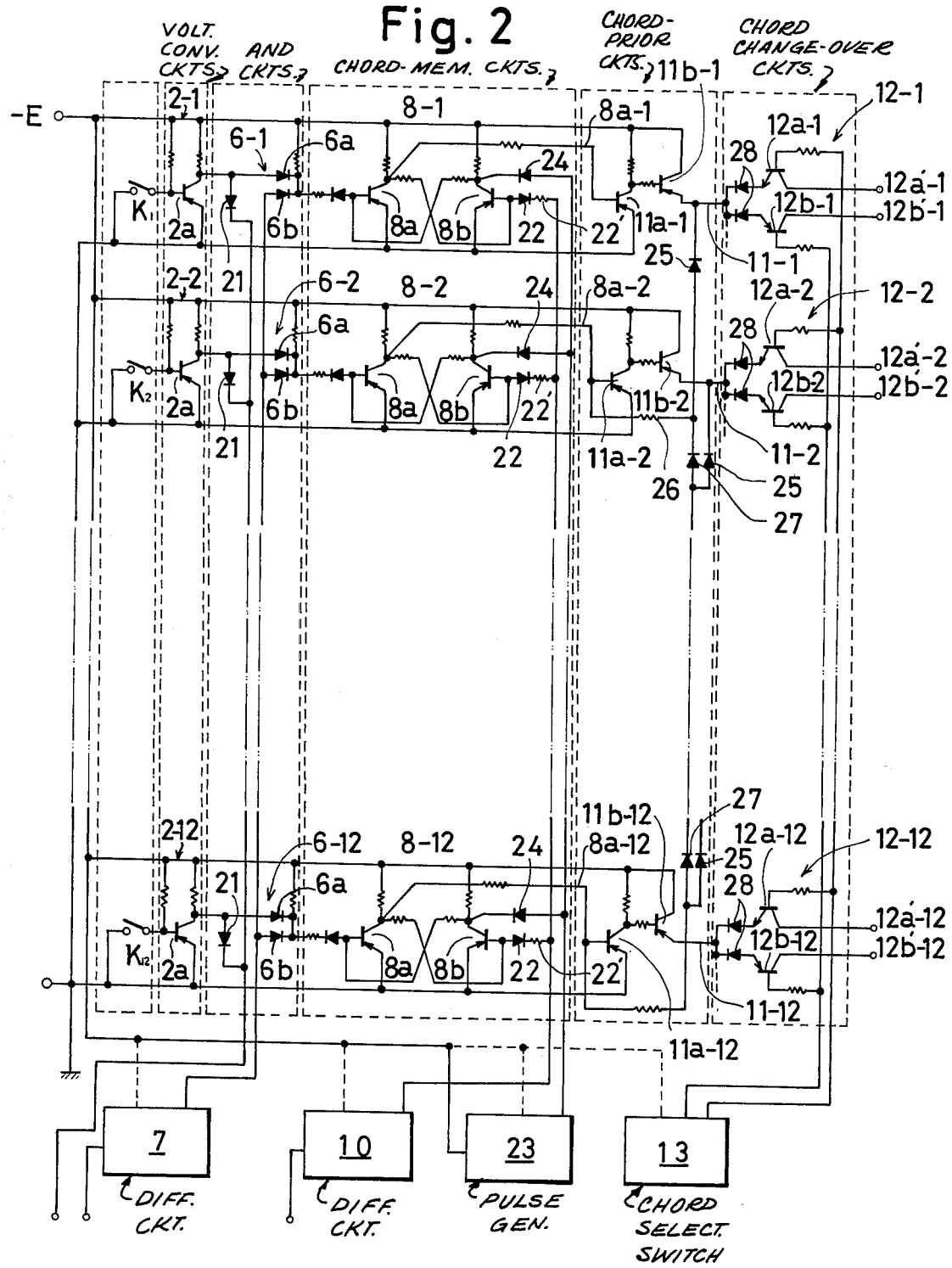
FIGS. 2 to 4 are detailed circuit diagrams of respective portions thereof.

In FIG. 2, each of the voltage conversion circuits 2-1,....2-12 comprises a transistor 2*a*. The key switches K1...K12 are connected for grounding base terminals of respective transistors 2*a*. Output terminals leading out from collector terminals are connected to respective input terminals of the AND circuits 6-1...6-12 and also connected through respective diodes 21 to the driving signal generator 3. Elements 6*a* and 6*b* are diodes for constituting each of the AND circuits 6-1...6-12.

Each of the chord-memory circuits 8-1...8-12 is composed of a flip-flop circuit comprising two transistors 8*a* and 8*b*. It is arranged that one of the transistors 8*a* or 8*b* is ordinarily in "ON" condition and the other is ordinarily in "OFF" condition. The output terminals 8*a*-1....8*a*-12 leading out from respective collectors of the transistors 8*a* are connected to respective transistors 11*a*-1....11*a*-12 of the chord-priority circuit 11. Respective bases of the other transistors 8*b* are connected through respective diodes 22 and resistors 22' to an output terminal of the differential circuit 10 connected to the final output terminals 4-*n* of the rhythm-pulse generator 4. Circuit 23 is a pulse generator which, when connected to an electric source, generates pulses for bringing each flip-flop circuit to its set condition. An output terminal thereof is connected through respective of diodes 24 to collectors of the transistor 8*b*.

If the key switch K1, for instance, is closed by depression, the transistor 2*a* of the voltage-conversion circuit 2-1 is grounded at its base. The voltage conversion circuit 2-1 is turned ON, whereby an output 1 is obtained at the collector of transistor 2*a*. This output is applied to the one input terminal of the first AND circuit 6-1 and at the same time to the rhythm-pulse generator 4 through the driving circuit 3. Thus, the rhythm-pulse generator 4 is driven and the first beat of the output pulse is generated. This pulse is differentiated and is applied to the other input terminals 6*b* of the AND circuits 6-1....6-12. Thereby, an output 1 is obtained at the output terminal of the first AND circuit 6-1. Thus, the first chord-memory circuit 8-1 receives an input pulse, whereby the transistor 8*a* is turned ON and the transistor 8*b* is turned OFF. The voltage generated at the collector of the transistor 8*a* is applied to the base of the first transistor 11*a*-1 of the chord-priority circuit 11 through the output terminal 8*a*-1. The transistors 8*a* and 8*b* are stabilized in this condition and, as described in detail hereinafter, are kept in this condition for a period of one bar until the final output pulse of the rhythm-pulse generator 4 is applied as a reset pulse thereto through the differential circuit 10.

The chord-priority circuit 11 comprises the foregoing input transistors 11*a*-1....11*a*-12, and output transistors 11*b*-1....11*b*-12 which are connected at their bases to the collectors thereof. These output transistors 11*b*-1....11*b*-12 are connected at their emitters to the bases of the respective next stage input transistors 11*a*-2....11*a*-12 through respective diodes 25 and resistors 26. The diode 25 and the resistor 26 are connected through a diode 27. Elements 11-1....11-12 are output terminals connected to the emitters of the transistors 11*b*-1....11*b*-12.

If, the key switches K1, K2, for instance, are simultaneously closed and thereby output signals are obtained from the first and the second chord-memory circuits 8-1,8-2, the transistor 11*a*-1 to which the output terminal of the first chord-memory circuit 8-1 is connected is turned OFF and the transistor 11*b*-1 is turned ON. Thus, the base of the first transistor 11*a*-2 provided at the next stage is brought into connection with the electric source E through the transistor 11*b*-1, the diode 25 and the resistor 26, so that the transistor 11*a*-2 is turned ON. Accordingly, the rear side transistor 11*b*-2, to which the collector thereof is connected is turned OFF and only the output transistor 11*b*-1 of the first chord-memory circuit 8-1 has priority. An output can be obtained in this case only from the output terminal 11-1 of the transistor 11*b*-1. This result is obtained not only in the case where two adjacent keys are simultaneously depressed, but also in the case where keys which are separate one from another are simultaneously depressed. Even when the first and the twelfth key switches K1, K12, for instance, are simultaneously depressed, the output terminal of the transistor 11*b*-1 is connected through the diodes 25 and 27 and the resistor 26 to the base of the transistor 11*a*-12 and this base is connected to the electric source E. The output of the first chord-memory circuit 8-1 thus has priority and no output from the twelfth chord-memory circuit 8-12 is obtained.

The output thus obtained from any of the chord-memory circuits circuts 8-1....8-12 is applied to the chord change-over circuits 12-1....12-12. These chord change-over circuits 12-1....12-12 comprise respectively two transistors 12*a*-1, 12*b*-1, 12*a*-2, 12*b*-2....12*a*-12, 12*b*-12 constituting respective two series that is, the S1...S12 series and P1....P12 series, and these are connected at their emitters through diodes 28 to the respective output terminals of the chord-priority circuit 11. The respective bases thereof are divided into two groups for the S1....S12 series and the P1...P12 series, respectively, and are respectively connected in common with the selection switch 13. The selection switch 13 comprises a change-over switch or a flip-flop circuit. It is arranged that either of the S1...S12 series or the P1...P12 series may be selected by giving a selected base voltage thereto. Specifically by giving a control voltage to the bases of the transistors 12*a*-1....12*a*-12, the transistors 12*a*-1....12*a*-12 are turned ON or by giving a control voltage to the bases of the transistors 12*b*-1....12*b*-12, the transistors 12*b*-1....12*b*-12 are turned ON. The respective collectors thereof constitute output terminals 12*a*'-1....12*a*'-12 and 12*b*'-1....12*b*'-12.

Thus, if it is assumed that the transistors 12*a*-1....12*a*-12 for the S1....S12 series are turned ON and, as mentioned before, the transistor 11*b*-1 of the chord-priority circuit 11 is turned ON by the output of the chord-memory circuit 8-1, the output obtained from the first output terminal 11-1 of the chord-memory circuit 11 passes through the transistor 12*a*-1 to provide an output at the emitter 12*a*'-1. This will become clearer from the further explanation which will follow hereinafter.

Figure 3:
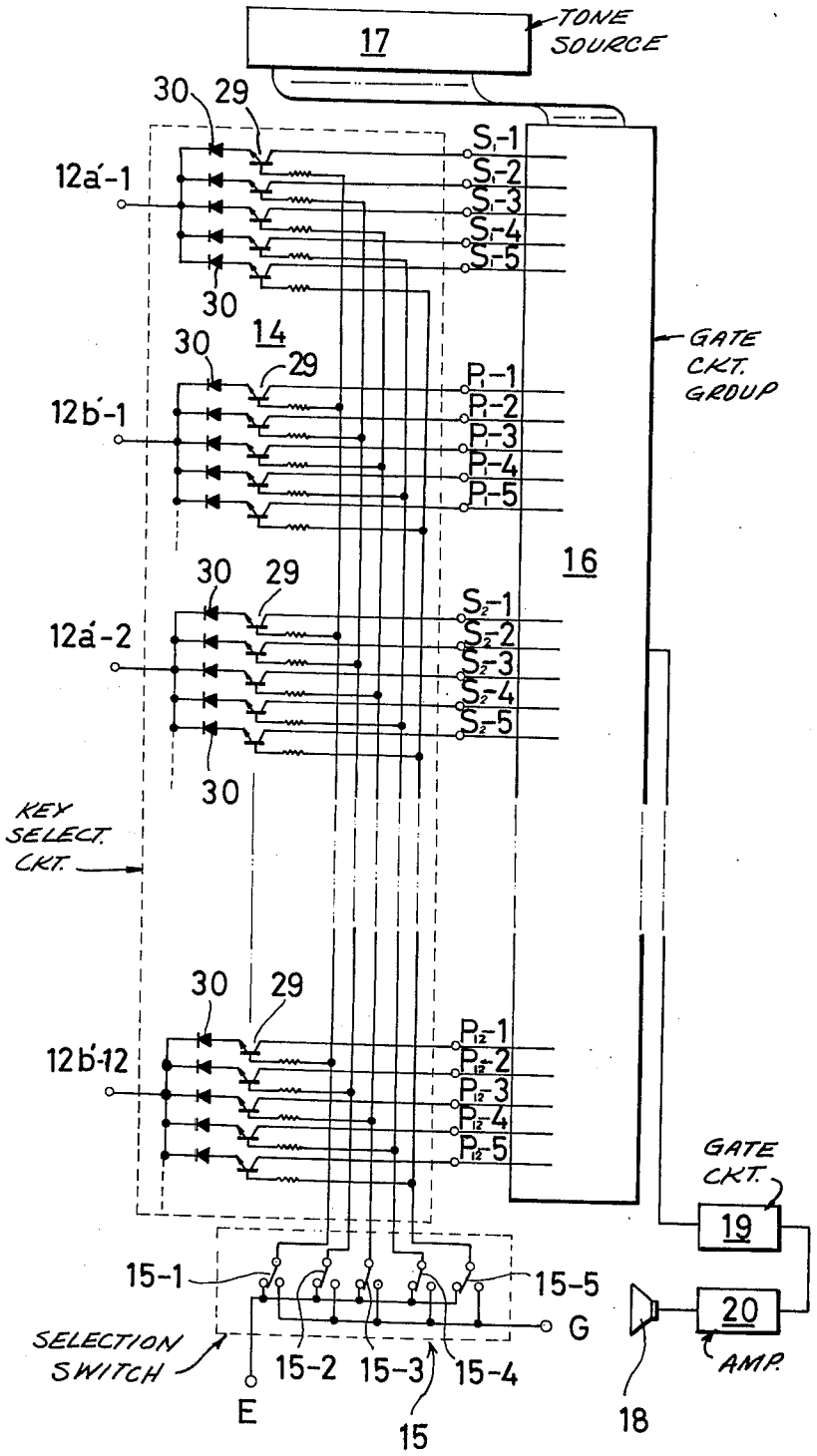

The output terminals 12*a*'-1....12*a*'-12 and 12*b*'-12 of the chord change-over circuits 12-1....12-12 are connected to the key-selection circuit 14. As shown in FIG. 3, for instance, the key selection circuit 14 has respective input terminals connected to the output terminals 12a'-1....12a'-12 and 12b'-1.....12b'-12 for the S1....S12 series and the P1....P12 series respectively. These input terminals are connected to groups of input terminals of transistors 29, which serve as switch elements which are opened and closed by selective operation of the key-selection switch circuit 15, through diodes 30 at their emitters to be in parallel one with another.

First order transistors 29 in each group of these transistor 29 are connected in common at their bases so as to be in connection with a selection switch 15-1 for the C key (C major), for instance. The second order transisotrs 29 are similarly connected at their bases in common to a selection switch 15-2 for the G key (G major), for instance. The third order transistors 29 are connected at their bases in common to a selection switch 15-3 for the Am key (A minor). The fourth order transistors are connected similarly to a selection switch 15-4 for the Dm key (D minor), and the fifth order transistors 29 are connected similarly to a selection switch 15-5 for the Em key (E minor), and so on.

Thus, any order transistor 29 can be turned ON when any of the selection switches **15-1, 15-2....15-*n* is selectively closed to be in connection with G. These transistors 29 are distributed to be in connection with respective chord gates 16a so that any chord-corresponding to any key and any tone may be selected. For instance, if it is intended that the C chord for the C key is to be combined at the output side of the first order transistor 29 in the transistor 29 group connected to the output terminal 12a'-1 of the S1 series, the collector of the first order transistor 29 is connected to chord gates 16a interposed at the output sides of the C tone, E tone and G tone of the tone source 17. Similarly, if it is intended that the G chord for the C key be combined at the output terminal 12a'-3 of the S3 series, it is connected to chord gates 16a interposed at the output sides of the D tone, G tone, and B tone of the tone source 17. Similarly, as shown in Table 1 hereunder, the respective first order transistors 29 of the output terminals 12a'-4.....12a'-8, 12a'-10, 12a'-12** are arranged to form Cm, C, F, B7, C, G7 chords. Additionally and similarly, respective principal chords for the G key, Am key, Dm key and Em key are formed.

Figure 4:
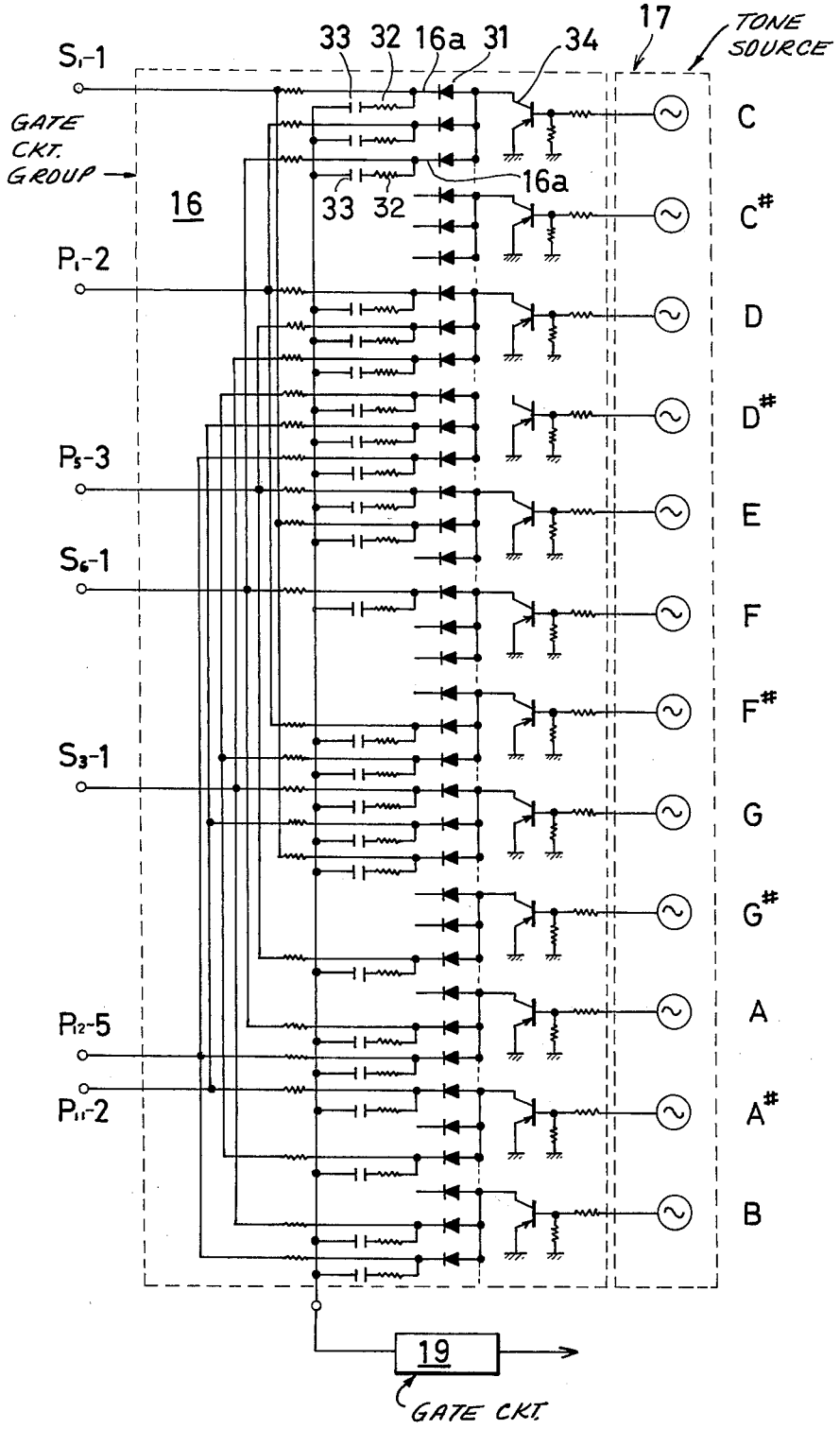

In some cases, in music beginning with the foregoing C, G, Am, Dm or Em key, any chord other than those ordinarily used for such keys, appears in the middle of the music. In order to meet such a requirement that a music must be played by changing over the initial chord to the chord appearing in the middle of the music, the apparatus is constructed as follows: The key-selection circuit 14 connected to the output terminals 12b'-1.....12b'-12 of the P1.....P12 series is provided on its output side with chord gates 16a as shown in Table 2 and FIG. 4. Each of these chord gates 16a comprises a transistor 34 which is connected at its base to a corresponding output terminal of the tone source, a diode 31 connected to the collector thereof, and a resistor 32 and a condenser 33 which are connected in series to the anode of the diode 31. These diodes 31 are connected at their anodes to the collectors of the respective transistors 29 of the key-selection circuit 14, and the output terminals of the condensers 33 are connected in common with gate circuit 19 which is arranged to be opened and closed by output pulses of the rhythm-pulse generator 4.

Thus, if any of the transistors 29 of the key selection circuit 14 is made conductive and the negative potential is applied to the anode of the diode 31, the diode 31 is turned ON and the transistor 30 is also turned ON, whereby a tone-source signal is allowed to pass therethrough and further through the diode 31, the resistor 32 and the condenser 33 and is applied to the gate circuit 19.

Thus, tone-source signals corresponding to chords selected by the foregoing chord change-over circuits 12-1....12-12 and the key-selection circuit 14 are applied to the gate circuit 19, and, every time the gate circuit 19 is opened by the rhythm pulses of the rhythm-pulse generator 4, these tone-source signals are passed through the gate circuit 19 thereby being obtained as a rhythm tone of a chord for the speaker 18.

Table 1

| Tone name / Key | C | C# | D# | D | E | F | F# | G | G# | A | A# | B |
|---|---|---|---|---|---|---|---|---|---|---|---|---|
| C (C major) | C | | G | Cm | C | F | $B_7$ | C | | $G_7$ | | $G_7$ |
| G (G major) | C | | G | E | G | | $D_7$ | G | | $D_7$ | | G |
| Am (A minor) | Am | | Dm | | Am | Dm | | Dm | | Am | | Dm |
| Dm (D minor) | | | Dm | | Dm | Dm | | Gm | Gm | Gm | Gm | |
| Em (E minor) | | | G | | Em | | | Em | | Am | | Em |

Table 2

| Tone name / Key | C | C# | D | D# | E | F | F# | G | G# | A | A# | B |
|---|---|---|---|---|---|---|---|---|---|---|---|---|
| C (C major) | Am | | Dm | | $G_7$ | $G_7$ | | $G_7$ | | Dm | | |
| G (G major) | $D_7$ | | $D_7$ | | | | | | | Am | E | |
| Am (A minor) | $F_7$ | $A_7$ | $E_7$ | $F_7$ | $E_7$ | $F_7$ | $D_7$ | $A_7$ | $E_7$ | $F_7$ | | $E_7$ |
| Dm (D minor) | B | $A_7$ | | | $E_7$ | F | | | | $A_7$ | | |
| Em (E minor) | | | $D_7$ | | C | | $B_7$ | | | $D_7$ | | $B_7$ |

The operation of the apparatus of this invention will next be explained in the following:

First, in accordance with the key of the music to be played, a selected one of the switches of the key-selection switch 15 is closed. For instance, when music in Dm (D minor) is to be played, as shown in FIG. 5, the selection switch 15-4 is closed and thereby grounded.

Figure 5:
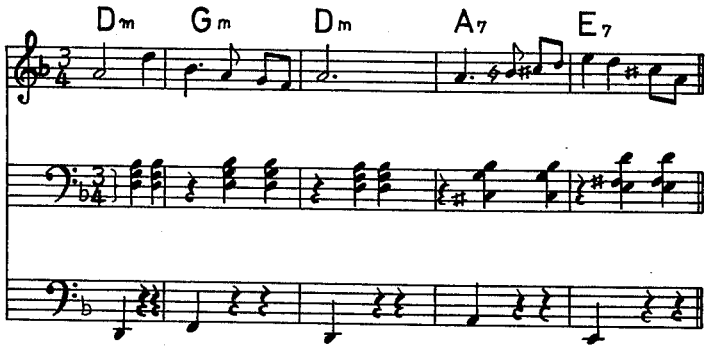
FIG. 5 is part of a musical score for explanation of an example of the playing thereof.

Next, since a chord Dm ordinarily used for a D minor key appears at the beginning of the music shown in FIG. 5, the chord change-over switch 13 is set for the side of the S1.....S12 series. Then, the rhythm-pulse generator 4 is adjusted to the 3/4 time of the music.

Thereafter, the melody of the music is played. As the first tone is an A tone, a key for the A tone is depressed, whereby an A tone is obtained in almost the same manner as in a conventional electronic musical instrument. (This is not illustrated because it is not different from the usual electronic musical instrument).

At the same time, the key switch K10 is closed and an output voltage is obtained at the output terminal of the voltage conversion circuit 2-10. This output voltage is applied to the AND circut 6-10 and at the same time to the rhythm-pulse generator 4 through the driving pulse generator 3 to drive the same. An output pulse obtained from the first output terminal 4-1 thereof is applied through the differential circuit 7 to the AND circuit 6-10. The pulse is allowed to pass through the AND circuit 6-10 and is applied to the chord-memory circuit 8-10. The flip-flop circuit of the chord-memory circuit 8-10 is reset and an output is obtained at the output terminal **8*a*-10 thereof. As at this stage, only a single key switch K10 is closed, the output thereof brings the output side transistor 11*b*-10 of the priority circuit 11 into its ON condition. As the S1....S12 series has been selected as mentioned before, the transistor 12*a*-10, to which the emitter of the transistor 11*b*-10 is connected, is turned ON, and the fourth order transistors 29, which are connected at their bases to the selection switch 15-4 for Dm of the key selection circuit 14 is turned ON. The chord gates 16*a* connected to the output terminals of the D,F and A tones are opened, whereby those tone-source signals pass through the gates 16*a* and are applied to the gate circuit 19. The gate circuit 19 is opened by the output pulse of the rhythm-pulse generator 4 and, as shown in FIG. 5,** during the period of one bar, the same is kept open to provide accompaniment tones.

When the accompaniment playing in the first bar is completed, the final pulse of the rhythm-pulse generator 4 is applied to the flip-flop circuits of the chord-memory circuits 8-1....8-12 to reset the same. The key for the first tone in the second bar is then depressed.

Assuming a key for the first tone A in the second bar is depressed, Gm chord tones can be obtained in almost the same manner as indicated above. Dm chord tones can then be obtained by the first tone A in the third bar. Though, next, the first A tone in the fourth bar is A, the chord for the same is A7. Therefore it would be a Dm chord if playing is continued without considering the change thereof. Thus, the chord change-over switch 13 is changed over from the S1....S12 series to the P1...P12 series and then the A tone key is depressed. Thereby, the A7 chord connected to P10 is selected as shown in Table 2 and there can be obtained the A7 chord tones. Thus, by playing the melody alone, the first tone in each bar is automatically detected and the accompaniment tones can be automatically detected and the accompaniment tones can be automatically obtained. Here, it is so arranged that the tone of the first beat in each bar may be obtained as a bass tone.

Though the above has been explained with reference to the case where the accompaniment tones can be obtained in the form of a chord, modification is possible such that, in the case of triple time, for instance, each chord is divided into the 1st, 3rd and 5th degrees, so that the rhythm accompaniment can be effected in that the 1st degree tone is played by the pulse of the first time, the 3rd degree tone is played by the pulse of the second time and the 5th degree tone is played by the pulse of the third time. Additionally, the invention has been described for the case where 12 key switches K1....K12 are provided, but it can be applied to all the keys such as by a parallel connection of key switch K11′, K12′, shown in FIG. 1.

Thus, according to this invention, if a melody playing is effected, the first tone in each bar is automatically memorized as a chord and the same is driven by rhythm pulses from the rhythm-pulse generator and thereby rhythm accompaniment is automatically effected. In this case, any desired music to be played can be selected at will according to the key thereof and a chord tone according thereto can be automatically obtained. Additionally, a special chord appearing in the middle of the music can be also automatically obtained by operation of the chord change-over switch. Thus, melody playing and accompaniment playing can be easily effected even by a beginner.

What is claimed is:

1. Apparatus for an electronic musical instrument comprising key means operable in accordance with the melody of music to be played, said music including a sequence of bars including at least one tone, a plurality of chord-memory means operable in response to the first melody tone of each bar, a chord gating means responsive to said chord-memory means for selectively transmitting a chord according to the tone operating the chord-memory means, audio means for audibly interpreting the chords transmitted by said chord gating means, and a rhythm pulse generator responsive to said key means for operating the chord gating means so that there is transmitted by said chord gating means rhythm-accompaniment tones corresponding to the first melody tones in the respective bars.

2. Apparatus as claimed in claim 1 comprising tone source means coupled to said chord gating means.

3. Apparatus as claimed in claim 2, wherein said music is characterized by a musical key, said apparatus further comprising a musical key selection means coupled to said chord gating means to control the latter according to said musical key.

4. Apparatus as claimed in claim 3 further comprising a chord change-over means coupled between said chord memory means and key selection means to control the response of the chord gating means to said key means.

5. Apparatus as claimed in claim 4 comprising manual selection means coupled to said key selection means and chord change-over means to operate the same.

6. Apparatus as claimed in claim 5 comprising differentiation circuit means coupling said rhythm pulse generator to said chord-memory means for clearing the latter at the end of each bar.

7. Apparatus as claimed in claim 6 comprising differentiation means coupled to said rhythm pulse generator and gates coupling the second said differentiation means and key means to said chord-memory means for the selective actuation of the same.

8. Apparatus as claimed in claim 7 comprising chord-priority means coupling said chord memory means to said chord gating means for controlling the response of said chord gating means to the chord-memory means according to a priority between said key means.

9. Apparatus as claimed in claim 8, wherein said key means includes a plurality of manually operable switches and said memory means includes a plurality of flip flops corresponding to said switches, comprising voltage conversion means coupling said switches to said gates and thru the latter to said flip flops.

10. Apparatus as claimed in claim 9 wherein said chord-priority means includes a plurality of transistor circuits coupled respectively between said flip flops and said chord change-over means for connecting the same, said transistor circuits being interconnected to establish a priority of operation.

11. Apparatus as claimed in claim 10 wherein said key selection means includes groups of transistors coupled to said transistor circuits to one of said manual selection means and to said chord gating means.

* * * * *